US009394038B2

(12) United States Patent
Hanscom

(10) Patent No.: US 9,394,038 B2
(45) Date of Patent: Jul. 19, 2016

(54) PADDLE RETAINER FOR STAND-UP PADDLEBOARDS

(71) Applicant: Eric Hanscom, Carlsbad, CA (US)

(72) Inventor: Eric Hanscom, Carlsbad, CA (US)

( * ) Notice: Subject to any disclaimer, the term of this patent is extended or adjusted under 35 U.S.C. 154(b) by 0 days.

(21) Appl. No.: 14/715,007

(22) Filed: May 18, 2015

(65) Prior Publication Data

US 2015/0360751 A1 Dec. 17, 2015

Related U.S. Application Data

(60) Provisional application No. 62/011,402, filed on Jun. 12, 2014.

(51) Int. Cl.
*B63B 17/00* (2006.01)
*B63B 35/79* (2006.01)

(52) U.S. Cl.
CPC ..... *B63B 35/7933* (2013.01)

(58) Field of Classification Search
CPC ..... B63B 35/7913
See application file for complete search history.

(56) References Cited

U.S. PATENT DOCUMENTS 6,659,822 B1 * 12/2003 Dombeck ..... B63B 35/73 441/35
8,887,423 B1 * 11/2014 Morgan ..... G08B 5/006 116/63 P
2013/0279106 A1 * 10/2013 Ergun ..... G06F 1/1607 361/679.26
2013/0340661 A1 * 12/2013 Siverts ..... B63B 35/7959 114/39.12

* cited by examiner

*Primary Examiner* — Stephen Avila
(74) *Attorney, Agent, or Firm* — Eric Hanscom; Todd J. Langford

(57) ABSTRACT

This invention provides a paddle retainer for stand-up paddleboards. There are two basic embodiments of the idea: a plug with a paddle-retaining slit that can be attached wherever the user wishes to attach it on the SUP, and a paddle-retaining slit built into the kicktail of the SUP. With both embodiments, the tip of the paddle is held within the slit portion by friction, such that SUP users can easily "store" their paddles in a vertical position while engaging in activities such as fishing that require them to store their paddles, and then easily retrieve their paddles without bending over to pick them up. The plug optionally has one or more holes into which fishing rods can be removably secured.

18 Claims, 5 Drawing Sheets

PADDLE RETAINER FOR STAND-UP PADDLEBOARDS

CROSS REFERENCE TO RELATED APPLICATIONS

This application claims priority to U.S. Provisional Application No. 62/011,402, filed Jun. 12, 2014, a true and correct copy of which is attached to this filing, and the contents of which are incorporated by reference.

STATEMENT REGARDING FEDERALLY SPONSORED RESEARCH OR DEVELOPMENT

This invention was not federally sponsored.

BACKGROUND OF THE INVENTION

1. Field of the Invention

This invention relates to the general field of stand-up paddleboards (SUPs), and more specifically toward a paddle retainer that can be used by a user of an SUP to position the paddle in a vertical position.

2. Statement of The Problem Solved

While paddling an SUP, most of the time the users have the paddle in their hands as it is being used to propel the SUP forward or to steer it. With some uses, however, it is advantageous to secure the paddle while the user is engaged in another activity. Fishing, for example, is commonly done from SUP's, and requires users to put down their paddle while using a fishing pole. The problem arises when the users then have to bend over to pick up the paddle, creating an inherently unstable position, and then get back to their feet. There is currently no means by which a user can store the paddle in a vertical position for easy retrieval.

3. Prior Art

There is considerable prior art that attempts to secure paddles to the deck of an SUP. For example, a variety of clips and clamps are well known in the prior art, however, they all store the paddle in a horizontal position. For kayaks and canoes, this storage method worked out very well, as the kayaker or canoer was already in a sitting or kneeling position, and therefore could reach easily the secured paddle without changing his or her body position significantly. However, this method does not work well for SUP users, as they are most vulnerable to falling off their boards when they are bending down and reaching to their paddle.

However, none of the prior art offers a means by which an SUP user's paddle can be stored vertically on the SUP.

SUMMARY OF THE INVENTION

The current invention provides just such a solution by having a vertical paddle retainer for stand-up paddleboards. There are two basic embodiments of the idea: a block with a paddle-retaining slit that can be attached wherever the user wishes to attach it on the SUP, and a paddle-retaining slit built into the kicktail of the SUP. With both embodiments, the tip of the paddle is held within the slit portion by friction, such that SUP users can easily "store" their paddles in a vertical position while engaging in activities such as fishing that require them to store their paddles, and then easily retrieve their paddles without bending over to pick them up.

It is a principal object of the invention to provide a means by which a paddle can be stored vertically on a stand-up paddleboard.

It is another object of the invention to provide a frictional slit into which a paddle can be removably secured in a vertical position during the use of an SUP.

An additional object of the invention calls for a block with a frictional slit, attachable by the user of the SUP at the location selected by the user, into which a paddle can be removably secured in a vertical position during the use of an SUP.

Another object of the invention is to provide a kicktail with a built-in frictional slit, into which a paddle can be removably secured in a vertical position during the use of an SUP.

It is a final object of this invention to provide a device that is inexpensive, unobtrusive, and does not negatively affect any of the common uses of an SUP, that allows users of the SUP to store their paddles in a vertical position during times when they are engaged in activities other than paddling.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims.

BRIEF DESCRIPTION OF THE FIGURES

The accompanying drawings, which are incorporated in and form a part of this specification, illustrate embodiments of the invention and together with the description, serve to explain the principles of this invention.

DETAILED DESCRIPTION OF THE INVENTION

Figure 1:
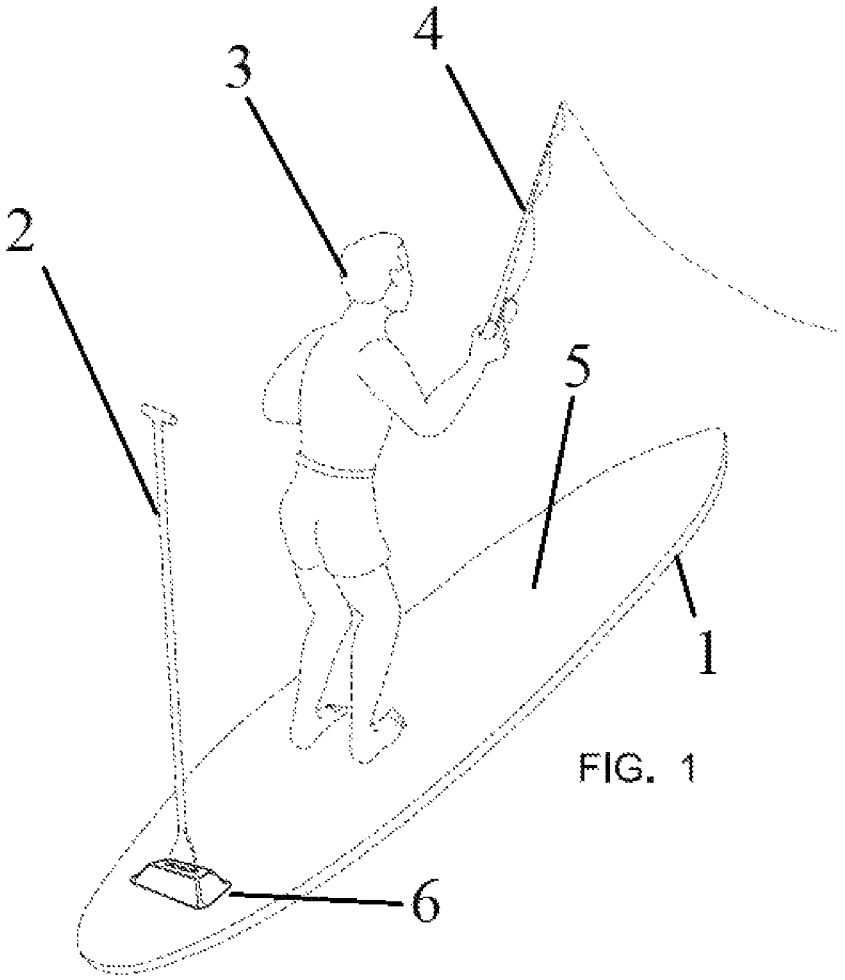
FIG. 1 is a perspective view of one embodiment of the invention, as attached to the rear of a stand-up paddleboard.

Many aspects of the invention can be better understood with the references made to the drawings below. The components in the drawings are not necessarily drawn to scale. Instead, emphasis is placed upon clearly illustrating the components of the present invention. Moreover, like reference numerals designate corresponding parts through the several views in the drawings.

REFERENCE NUMBERS

1. Stand-up paddleboard
2. Paddle
3. Paddler
4. Fishing Pole
5. Deck of stand-up paddleboard
6. Plug, generally, first embodiment.
  6A. Plug, generally, second embodiment.
7. Front face
8. Back face
9. Side face
10. Top face

11. Bottom face
12. Slit
13. Hole (for fishing rod)
14. Hole ridges
15. Slit ridges
16. Kicktail
17. End of board
18. Fin of board
19. Riser
20. Edge (of kicktail)

FIG. 1 is a perspective view of one embodiment of the invention, as attached to the rear of a stand-up paddleboard. The user 3 has removably secured his paddle 3 in a plug 6 that has been attached to the deck 5 of his paddleboard 1. The plug has two long sides—a front face 7 and a back face 8, and two short side faces 9, and a slit 12 on its top face 10. The plug also has a bottom face 11, which can be glued to the deck of the stand-up paddleboard, or, alternatively, attached via any sticky substance or attached via suction cups. The slit 12 has sides that are made of plastic, foam or some other compressible substance, and create a cavity that is slightly narrower that the depth of the average paddle, such that a paddle can be shoved into the slit and removably retained therein while the paddler fishes or engages in another activity requiring both hands. Thus, the slit removably retains the tip of the paddle blade such that the paddler can use both hands for activities other than paddling. The average stand-up paddleboard paddle is approximately 8" to 10" wide, and in most cases less than ¼" in width.

Figure 2:
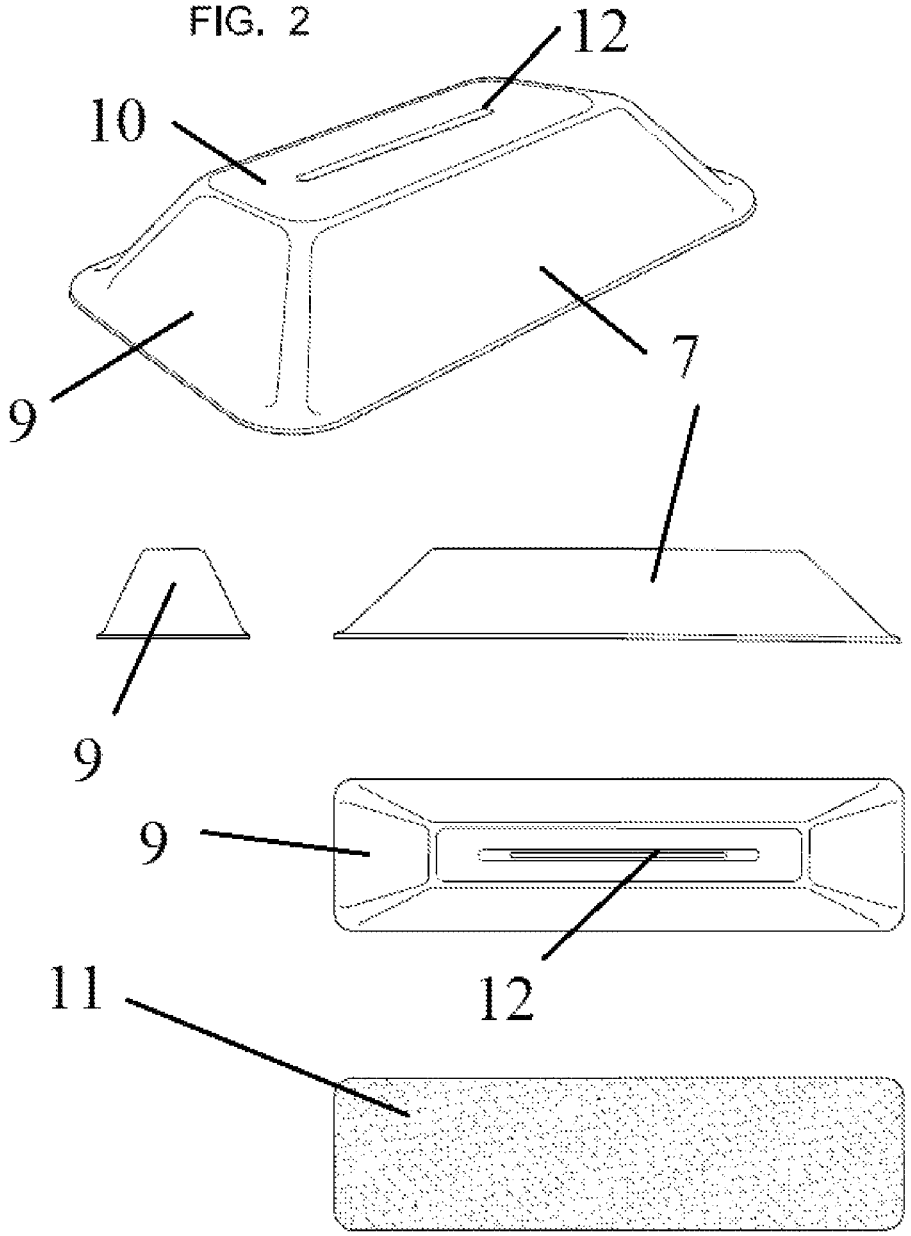
FIG. 2 is a series of views of this first embodiment of the invention.

FIG. 2 is a series of views of this first embodiment of the invention. To use this embodiment, the user attaches the bottom face 11 to any part of his stand-up paddleboard he wishes, then removably secures his paddle into the slit 12 on the top face 10 of the stand-up paddleboard. As with second embodiment, the bottom of the plug can be adhered to the deck of the stand-up paddleboard through double-sided tape or some other type of adhesive. It is also contemplated that the plug could be adhered permanently through use of contact cement, resin, or some other, more permanently binding adhesive.

Because the bottom face 11 is longer and wide than the top face 10, the invention is secured against wave action that the angled faces of the various sides serve to deflect wave energy over the plug rather than against it. The plug, when attached at the back of the stand-up paddleboard, can actually serve as a "kicktail" that allows a user to rest his rear foot against this obstruction while surfing an ocean wave.

Figure 3:
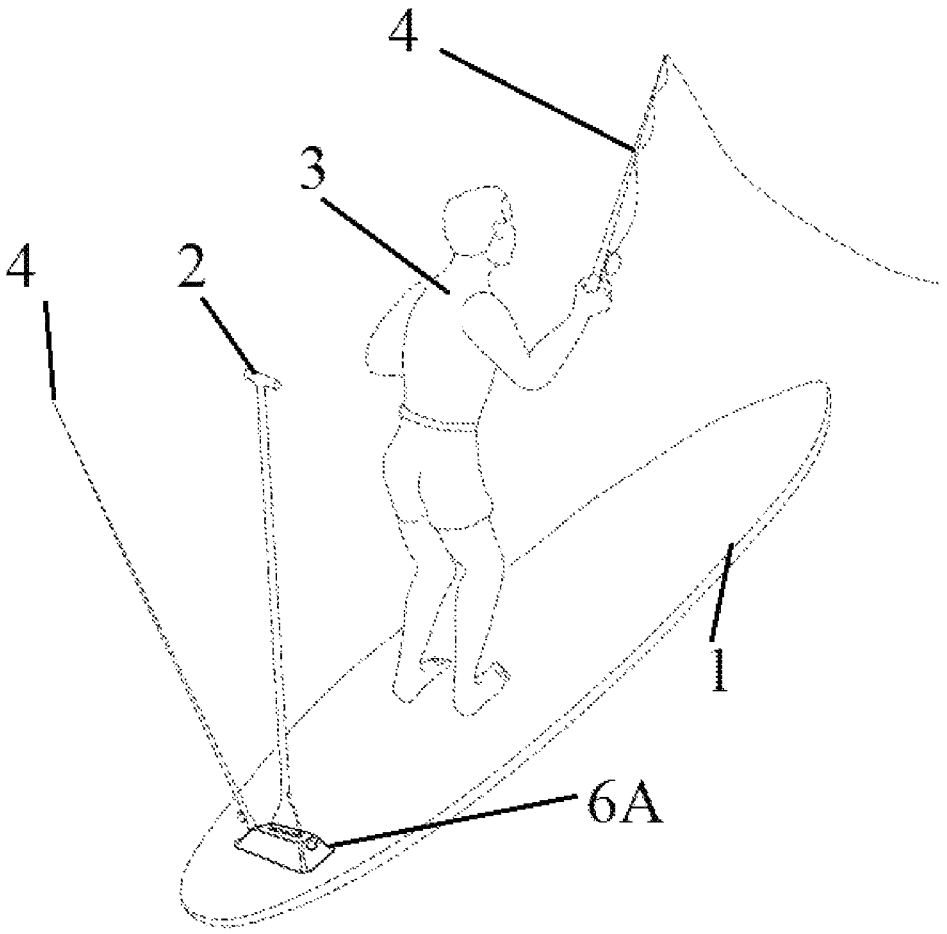
FIG. 3 is a perspective view of a second embodiment of the invention, as attached to the rear of a stand-up paddleboard.

FIG. 3 is a perspective view of a second embodiment of the invention, as attached to the rear of a stand-up paddleboard. This embodiment is very similar to the first embodiment, illustrated in FIGS. 1 and 2, except that the plug, designated 6A in this case, has one or more holes into which fishing rods 4 can be removably secured. This provides multiple advantages. First, the paddler can "troll" with one of more fishing rods as he paddles. Second, he can bring along at least two fishing rods, and store them conveniently and securely in the plugs (it should be known that the current method of fishing from a stand-up paddleboard is to stuff the butt end of the fishing rod down a user's life jacket, then pull it out when the user wishes to fish. This method is, of course, inconvenient and can be dangerous as hooks and lures sometimes do not stay secured to the rod.

Figure 4:
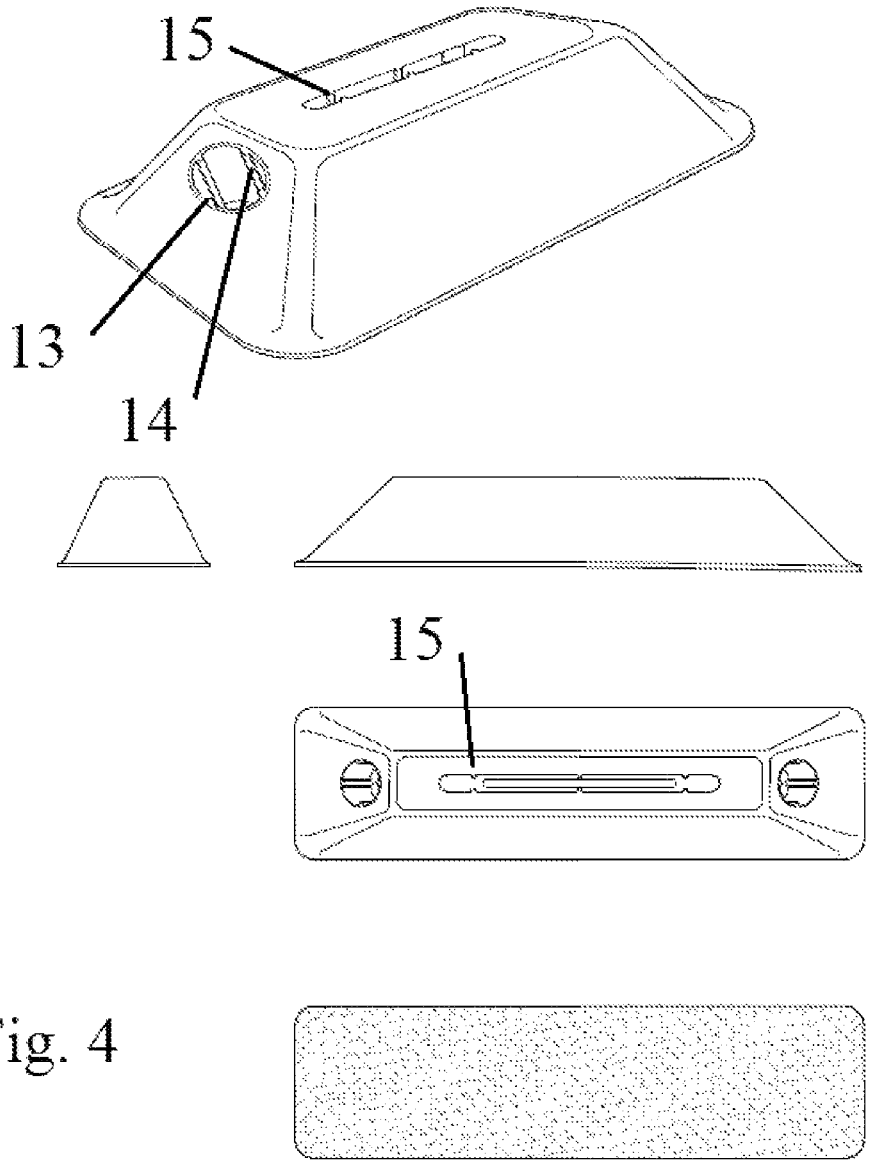
FIG. 4 is a series of views of this second embodiment of the invention.

FIG. 4 is a series of views of this second embodiment of the invention. The plug is fairly similar to the first embodiment, as illustrated by FIG. 2, except the for holes 13 for the fishing rod. In the figure, two additional, optional means of better securing the paddle and fishing rod are shown. The fishing rod hole 13 as hole ridges 14, which are small protuberances which extend into the hole, thereby gripping the butt of the fishing rod more securely. The slit 12 in this figure also shows the slit ridges 15, which are small, vertical protrusions that more securely grip the paddle. In this figure, the protrusions come from both sides of the slit at the same locations, but optionally, the protrusions could come from only one side, or some from both sides and be offset from one another.

Figure 5:
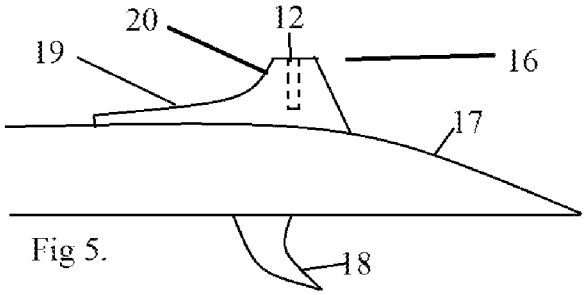
FIG. 5 is a side view of the paddle-retaining plug built into a standard kicktail of a stand-up paddleboard.

FIG. 5 is a side view of the paddle-retaining plug built into a standard kicktail of a stand-up paddleboard. Generally referenced as 16, the kicktail/plug attaches to the deck of a stand-up paddleboard at its rear section 17, usually right around the fin 18, by traditional means such as adhesives. The kicktail has a front portion or riser 19 upon which the rider's foot is designed to rest, and a raised portion or edge 20, which is designed to stop the rider's foot from slipping off the back of the stand-up paddleboard. Inside the raised portion, there is a slit 12, into which the paddle can be wedged when the paddle is not in use.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

What I claim is:

1. A paddle-retaining device for removably securing a paddle to a stand-up paddleboard in a vertical position, where the paddle-retaining device comprises a plug of semi-rigid material with a length and a width, where the plug has a front face, a back face, a top face, a bottom face and two side faces, and where the top face additionally comprises a paddle-retaining slit, where the paddle-retaining slit comprises a cavity built into the top face, where the paddle-retaining slit has a front side, a back side, a length, a depth, and a width, where the length of the slit is less than 10 inches, where the cavity has a normal state and a retaining state, where the normal state is that when there is no paddle inserted into the cavity, and, where the retaining state is that when a length of a blade portion of the paddle has been inserted into the cavity, and where in the retaining state at least a portion of the front side and at least a portion of the back side are in contact with the paddle where the plug is a trapezoidal prism with a width greater than a length, where the plug is attached to a stand up paddleboard with its width perpendicular to the length of the stand-up paddleboard, and where the depth of the slit is less than 4".

2. The paddle-retaining device of claim 1, where the side faces of the plug have an upper length and lower length, and where the upper length is less than the lower length, thereby creating a plug with a larger bottom than top, and where in the normal state the width of the slit is less than ¼ inch.

3. The paddle-retaining device of claim 2, where the cavity additionally comprises one or more ribs where the one or more ribs protrude into the cavity and exerts an additional amount of pressure on the paddle, thereby securing it more securely.

4. The paddle-retaining device of claim 2, where the cavity additionally comprises one or more ribs where the one or more ribs protrude into the cavity and, where the cavity additionally comprises one or more vertical cavities, where the one or more vertical cavities comprises a vertical indentation into an edge of the cavity, and where the one or more ribs mates with the one or more vertical cavities such that the one or more ribs exerts an additional amount of pressure on the paddle, thereby securing it more securely.

5. The paddle-retaining device of claim 1, where the paddle-retaining device additionally comprises a front portion, where the front portion is a kicktail front, where the kicktail front comprises a relatively flat and gently sloped section similar to the front of a standard kicktail of a surfboard, that raises in elevation to an elevated top face, where the rise in elevation is steeper as the kicktail raises in elevation to meet the top face, where the section where the elevation increases most steeply is called a steep portion, where the kicktail front additionally comprises a top surface, where the top surface comprises a non-skid surface, such that a user of the invention can nestle his or her foot on the kicktail front, utilizing the non-skid surface for traction, and have his or her foot abut the steep portion to prevent the foot from sliding off the back of the stand-up paddleboard.

6. The paddle-retaining device of claim 5, where the width of the slit in the normal state is less than ¼" in width, and where the plug is a trapezoidal prism with a width greater than a length, where the plug is attached to a stand up paddleboard with its width perpendicular to the length of the stand-up paddleboard, and where the depth of the slit is less than 4".

7. The paddle-retaining device of claim 5, where the side faces of the plug have an upper length and lower length, and where the upper length is less than the lower length, thereby creating a plug with a larger bottom than top, and where in the normal state the width of the slit is less than ¼ inch.

8. The paddle-retaining device of claim 7, where the block is a trapezoidal prism with a length greater than a width.

9. The paddle-retaining device of claim 7, where the cavity additionally comprises one or more ribs where the one or more ribs protrude into the cavity and exerts an additional amount of pressure on the paddle, thereby securing it more securely.

10. The paddle-retaining device of claim 7, where the cavity additionally comprises one or more ribs where the one or more ribs protrude into the cavity and, where the cavity additionally comprises one or more vertical cavities, where the one or more vertical cavities comprises a vertical indentation into an edge of the cavity, and where the one or more ribs mates with the one or more vertical cavities such that the one or more ribs exerts an additional amount of pressure on the paddle, thereby securing it more securely.

11. The paddle-retaining device of claim 6, where the bottom face is flat and additionally comprises an adhesive and a cover, where the cover can be removed and the adhesive put in contact with the surface of the stand-up paddleboard to secure the stand-up paddleboard retainer to the surface of the stand-up paddleboard.

12. A paddle-retaining device for removably securing a paddle to a stand-up paddleboard in a vertical position, where the paddle-retaining device comprises a plug of semi-rigid material with a length and a width, where the plug has a front face, a back face, a top face, a bottom face and two side faces, and where the top face additionally comprises a paddle-retaining slit, where the paddle-retaining slit comprises a cavity built into the top face, where the paddle-retaining slit has a front side, a back side, a length, a depth, and a width, where the length of the slit is less than 10 inches, where the cavity has a normal state and a retaining state, where the normal state is that when there is no paddle inserted into the cavity, and, where the retaining state is that when a length of a blade portion of the paddle has been inserted into the cavity, and where in the retaining state at least a portion of the front side and at least a portion of the back side are in contact with the paddle, and where the paddle retaining device additionally comprises one or more holes, into which the end of a fishing pole can be inserted, where the block is a trapezoidal prism with a length greater than a width, and where the cavity additionally comprises one or more ribs and one or more vertical cavities, where the one or more ribs mates with the one or more vertical cavities such that the one or more ribs exerts an additional amount of pressure on the paddle, thereby securing it more securely.

13. The paddle-retaining device of claim 12, where at least one of the one or more holes comprises one or more ribs where the one or more ribs exerts an additional amount of pressure on the bottom of the fishing pole, thereby securing it more securely.

14. The paddle-retaining device of claim 13, where the paddle-retaining device additionally comprises a front portion, where the front portion is a relatively flat and gently sloped section similar to the front of a standard kicktail.

15. A paddle-retaining device for removably securing a paddle to a stand-up paddleboard in a vertical position, where the paddle-retaining device comprises a plug of semi-rigid material with a length and a width, where the plug has a front face, a back face, a top face, a bottom face and two side faces, and where the top face additionally comprises a paddle-retaining slit, where the paddle-retaining slit comprises a cavity built into the top face, where the paddle-retaining slit has a front side, a back side, a length, a depth, and a width, where the length of the slit is less than 10 inches, where the cavity has a normal state and a retaining state, where the normal state is that when there is no paddle inserted into the cavity, and, where the retaining state is that when a length of a blade portion of the paddle has been inserted into the cavity, and where in the retaining state at least a portion of the front side and at least a portion of the back side are in contact with the paddle, where the paddle-retaining device additionally comprises a front portion, where the front portion is a kicktail front, which comprises a relatively flat and gently sloped section similar to the front of a standard kicktail of a surfboard, that raises in elevation to an elevated top face, where the rise in elevation is steeper as the kicktail raises in elevation to meet the top face, where the section where the elevation increases most steeply is called a steep portion, where the kicktail front additionally comprises a top surface, where the top surface comprises a non-skid surface, such that a user of the invention can nestle his or her foot on the kicktail front, utilizing the non-skid surface for traction, and have his or her foot abut the steep portion to prevent the foot from sliding off the back of the stand-up paddleboard.

16. The paddle-retaining device of claim 15, where the width of the slit in the normal state is less than ¼" in width, and where the cavity additionally comprises one or more ribs where the one or more ribs protrude into the cavity and exerts an additional amount of pressure on the paddle, thereby securing it more securely, and where the paddle retaining device additionally comprises one or more holes, into which the end of a fishing pole can be inserted.

17. The paddle-retaining device of claim 16, where the cavity and the one or more holes additionally comprises one or more ribs where the one or more ribs protrude into the cavity and, where the cavity additionally comprises one or more vertical cavities, where the one or more vertical cavities comprises a vertical indentation into an edge of the cavity, and where the one or more ribs mates with the one or more vertical cavities such that the one or more ribs exerts an additional amount of pressure on the paddle, thereby securing it more securely, and, where the bottom face is flat and additionally comprises an adhesive and a cover, where the cover can be removed and the adhesive put in contact with the surface of the stand-up paddleboard to secure the stand-up paddleboard retainer to the surface of the stand-up paddleboard.

18. The paddle-retaining device of claim 16, where the bottom face is flat and additionally comprises an adhesive and a cover, where the cover can be removed and the adhesive put in contact with the surface of the stand-up paddleboard to secure the stand-up paddleboard retainer to the surface of the stand-up paddleboard.

* * * * *